United States Patent [19]

Franklin et al.

[11] Patent Number: 4,921,662

[45] Date of Patent: May 1, 1990

[54] PRESSURE PULSE CLEANING METHOD

[75] Inventors: Richard D. Franklin, Jeannette; Gregg D. Auld, Trafford; David E. Murray, Greensburg; John J. Lescisin, Pittsburgh; Albert R. Vaia, Export; Thomas E. Dunn, Pittsburgh, all of Pa.

[73] Assignee: Westinghouse Electric Corp., Pittsburgh, Pa.

[21] Appl. No.: 183,874

[22] Filed: Apr. 19, 1988

[51] Int. Cl.[5] ..... F22B 37/48

[52] U.S. Cl. ..... 376/316; 122/382; 122/392; 134/22.18

[58] Field of Search ..... 376/260, 316, 308, 309, 376/310; 122/381, 382, 392, 397; 165/95, 84; 134/22.18, 169 R

[56] References Cited

U.S. PATENT DOCUMENTS

| | | | |
|---|---|---|---|
| 2,604,895 | 7/1952 | Fechter . | |
| 3,180,418 | 7/1965 | MacLeod . | |
| 3,364,983 | 1/1968 | Krinov et al. . | |
| 3,409,470 | 11/1968 | Karpovich . | |
| 3,457,108 | 7/1969 | Hittel . | |
| 4,057,034 | 11/1977 | Farquhar et al. | 376/316 |
| 4,079,701 | 3/1978 | Hickman et al. | 376/310 |
| 4,492,113 | 1/1985 | Weatherholt . | |
| 4,492,186 | 1/1985 | Helm . | |
| 4,645,542 | 2/1987 | Scharton et al. . | |
| 4,655,846 | 4/1987 | Scharton et al. | 376/316 |
| 4,676,201 | 6/1987 | Lahoda et al. . | |
| 4,699,665 | 10/1987 | Scharton et al. . | |
| 4,715,324 | 12/1987 | Muller et al. | 122/381 |
| 4,756,770 | 7/1988 | Weems et al. | 376/316 |
| 4,773,357 | 9/1988 | Scharton et al. | 122/382 |

FOREIGN PATENT DOCUMENTS

| | | |
|---|---|---|
| 0133449 | 2/1985 | European Pat. Off. . |
| 1105895 | 5/1961 | Fed. Rep. of Germany |
| 48-89567 | 6/1973 | Japan . |
| 575147 | 10/1977 | U.S.S.R. . |
| 597443 | 3/1978 | U.S.S.R. . |

OTHER PUBLICATIONS

U.S. patent application Ser. No. 501,979 filed Jun. 7, 1983 for "Flow Control Method for Radioactive Decontamination of Nuclear Steam Generator" by Burack et al.

Proposal for Steam Generator Pressure Pulse/Sludge Lance at Farley, dated Sep. 17, 1986.

Pressure Pulse Cleaning in Westinghouse Recirculating Steam Generators (Model 51), dated Oct. 1986.

Proposal to CECO/Byron Station Unit 1 for Steam Generator Sludge Lancing and Optional Pressure Pulse Cleaning, dated Dec. 1, 1986.

Proposal to Commonwealth Edison for Steam Generator Sludge Lancing Zion Station 2, dated Mar. 4, 1987.

*Primary Examiner*—Daniel Wasil

[57] ABSTRACT

A method for loosening and removing sludge and debris from the vessel of a heat exchanger, such as the secondary side of a nuclear steam generator, is disclosed herein. The method generally comprises the steps of providing a sufficient volume of a liquid, such as water, into the steam generator so that the lower portion which includes the tubesheet is submerged, and then generating a succession of pressure pulses within the water from one or more pressure pulse generators wherein each pressure pulse creates shock waves that exert momentary forces throughout the submerged portion of the generator of a magnitude sufficient to loosen the sludge and debris, but safely below the yield and fatigue limits of the heat exchanger tubes and other components within the generator. The pressure pulses commence as soon as a sufficient amount of water is introduced into the steam generator to submerge the tubesheet, and continue all the way through the draining of the steam generator.

39 Claims, 10 Drawing Sheets

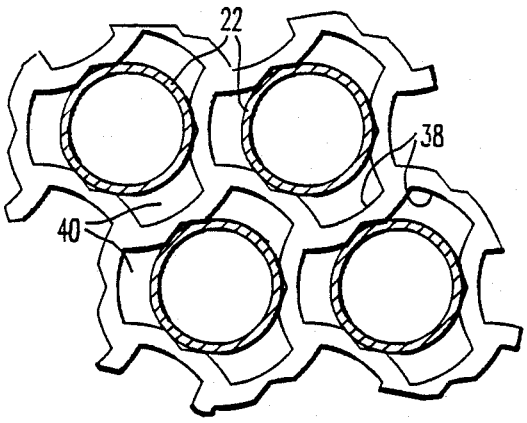
FIG. 4A
FIG. 4B
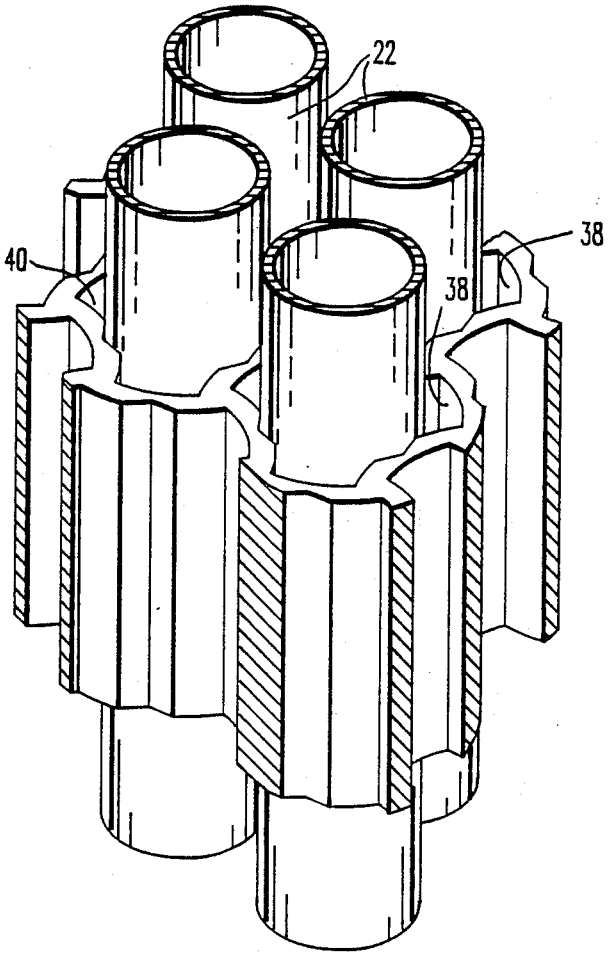

PRESSURE PULSE CLEANING METHOD

BACKGROUND OF THE INVENTION

This invention generally relates to methods for cleaning heat exchanger vessels, and is specifically concerned with an improved pressure pulse cleaning method for loosening and removing sludge and debris from the secondary side of a nuclear steam generator.

Pressure pulse cleaning methods for cleaning the interior of the secondary side of a nuclear steam generator are known in the prior art, and have been disclosed and claimed in U.S. Pat. Nos. 4,655,846 and 4,699.665. The purpose of these methods is to loosen and remove sludge and debris which accumulates on the tubesheet, heat exchanger tubes and support plates within the secondary side. In such methods, the secondary side of the generator is first filled with water. Next, the outlet of a gas-operated pressure pulse generator is placed into communication with the water. Such communication may be implemented by a nozzle which may be formed from either a straight section of pipe oriented horizontally over the tubesheet of the generator, or a pipe having a 90 degree bend which is oriented vertically over the tubesheet. Both of these prior art methods generally teach generating pressure pulses within the water by emitting gas through the nozzle that is pressurized to between 50 and 5000 pounds per square inch. The pulses are repeated at a frequency of one per second, and the succession of pulses may last anywhere from between 1 and 24 hours. The pressure pulses create shock waves in the water surrounding the tubesheet, the heat exchanger tubes and support plates within the secondary side of the generator. These shock waves effectively loosen and remove sludge deposits and other debris that accumulates within the secondary side over protracted periods of time.

While the cleaning methods disclosed in these patents represent a major advance in the state of the art, the applicants have found that there are limitations associated with these methods which limit their usefulness in cleaning nuclear steam generators. However, before these limitations may be fully appreciated, some general background as to the structure, operation and maintenance of nuclear steam generators is necessary.

In the secondary side of such steam generators, the vertically-oriented legs of the U-shaped heat exchanger tubes extend through bores in a plurality of horizontally-oriented support plates vertically spaced from one another, while the bottom ends of these tubes are mounted within bores located in the tubesheet. The relatively small annular spaces between these heat exchanger tubes and the bores in the support plates and the bores in the tubesheet are known in the art as "crevice regions." Such crevice regions provide only a very limited flow path for the feed water that circulates throughout the secondary side of the steam generator. The consequent reduced flow of water through these crevice regions results in a phenomenon known as "dry boiling" wherein the feed water is apt to boil so rapidly that these regions can actually dry out for brief periods of time before they are again immersed by the surrounding feed water. This chronic drying-out of the crevice regions due to dry boiling causes impurities dissolved in the water to precipitate out in these regions. The precipitates ultimately create sludge and other debris which can obstruct the flow of feed water in the secondary side of the generator to an extent to where the steam output of the generator is seriously compromised. Moreover, the presence of such sludges is known to promote stress corrosion cracking in the heat exchanger tubes which, if not arrested, will ultimately allow water from the primary side of the generator to radioactively contaminate the water in the secondary side of the generator.

To remove this sludge, many cleaning methods were used prior to the advent of pressure pulse cleaning techniques. Examples of such prior art cleaning methods include the application of ultrasonic waves to the water in the steam generator to loosen such debris, and the use of a high-powered jet of pressurized water to flush such debris out (known as "sludge lancing"). However, such techniques were only partially successful due to the hardness of the magnitite deposits which form a major component of such sludges, and the very limited accessibility of the crevice regions of the steam generator.

Since its inception, pressure pulse cleaning has been a very promising way in which to remove such stubborn deposits of sludges in such small spaces, since the shock waves generated by the gas operated pressure pulse operators are capable of applying a considerable loosening force to such sludges. However, the applicants have found that the methods disclosed in both U.S. Pat. Nos. 4,655,846 and 4,699,665 have fallen short of fulfilling their promise in several material respects. For example, research conducted by the applicants indicates that pressure pulses generated by gas pressurized at the lower end of the 50 to 5000 psi range are generally too weak to effectively dislodge significant amounts of such crevice-region sludges. While pressure pulses generated by gas pressurized at the upper end of to 50 to 5000 psi range would certainly be powerful enough to loosen and remove the sludges, this same research indicates that the shock waves resulting from such pulses are capable of generating momentary forces that would jeopardize the integrity of the heat exchanger tubes in the vicinity of the nozzle of the pressure pulse generator. Thus the prior art does not specifically indicate what range of pressure is the most effective. Still another shortcoming observed by the applicants was the lack of any means to remove dissolved ionic species from the water during such prior art cleaning processes. Such ionic species, if not removed, are capable of precipitating out in the form of new sludges after the termination of the pressure pulse cleaning process if no provision is made to remove them. Additionally, applicants observed that if the fine particulate matter that is dislodged from the crevice regions is not removed from the water during the pressure pulse cleaning method, these fine particles of sludge are capable of settling onto the tubesheet and densely depositing themselves into the crevice regions between the tubesheet and the legs of the heat exchanger tubes, thereby defeating one of the purposes of the cleaning method. The applicants have further observed that the usefulness of prior art pressure pulse cleaning processes is limited by the one pulse per second frequency that these methods teach. Specifically, the applicants have observed that the relatively rapid pulse frequency taught in the prior art does not give the nozzle and manifold of the pulse generator sufficient time to fill back with water, and thus leaves pockets of shock-absorbing gas in the nozzle of the pulse generator which limits the efficacy of later generated pulses in generating sludge-loosening shock waves. Finally, the applicants have observed that the maximum 24 hour time limit taught in U.S. Pat. Nos. 4,655,846 and 4,699,665 may not be sufficient to completely loosen and remove all of the sludges and debris from the interior of the secondary side of a typical steam generator.

Clearly, what is needed is an improved pressure pulse cleaning apparatus which overcomes the limitations associated with prior art pressure pulse cleaning methods and which is imminently practical for use in the secondary side of a nuclear steam generators.

SUMMARY OF THE INVENTION

Generally speaking, the invention is a method for loosening and removing sludge and debris from the interior of the vessel of a heat exchanger, such as the secondary side of a nuclear steam generator, that overcomes the limitations associated with the prior art. The method comprises the steps of filling the secondary side with a sufficient volume of water so that the tubesheet and portions of the heat exchanger tubes are completely submerged therein, and then generating a succession of pressure pulses within the water from one or more pressure pulse generators in order to create shock waves of an optimum power level that exert momentary pressures throughout the submerged portion of the secondary side of a magnitude sufficient to effectively loosen the sludge and debris, but insufficient to cause yielding or fatigue in the heat exchanger tubes and other components within the secondary side. Applicants have found that these momentary pressures can have a maximum magnitude of between 10 and 30 ksi, and are more preferably of a magnitude of between 15 and 25 ksi, depending upon the condition of the heat exchanger tubes contained therein.

The pressure pulse generators each preferably include an opening that communicates with a lower portion of the secondary side of the steam generator for introducing a pulse of compressed gas therein. In the preferred method of the invention, each of the pressure pulses is generated by discharging between 50 and 100 cubic inches of inert gas into the water that is pressurized to between 200 and 1600 psi, depending upon the level of the water within the secondary side. If the level of the water is high enough to submerge only the tubesheet, the lower portion of the heat exchanger tubes, and the outlet of the pulse generator, then the gas is pressurized to between only about 200 and 600 psi. If the level of the water is raised to submerge the upper support plates within the secondary side, the pressure of the gas is raised to between 600 and 1600 psi in order to compensate for the diminishment of the shock waves generated by the pulses as a result of the increase of the static pressure of the water around the outlet of each of the pressure pulse generators. The applicants have empirically observed that when pressure pulses are generated by pressurized gas in accordance with the aforementioned parameters, that the resulting shock waves are powerful enough to effectively remove sludge and debris, yet the maximum magnitude of the momentary pressure applied to the heat exchanger tubes in the vicinity of the outlets of the pressure pulse generators is well below the 30 ksi limit. Hence, the shock waves created by such pressure pulses do not jeopardize the integrity of the heat exchanger tubes in the vicinity of the outlet of each of the pressure pulse generators.

Each of the pressure pulse generators may generate one pressure pulse between about every 5 to 15 seconds, and preferably between every 7 and 10 seconds. The applicants have empirically observed that when pressure pulses are generated within the aformentioned frequency range, that the nozzle and other components of the pressure pulse generator have time to fill back up with water so that there are no residual pockets of gas in the device that could significantly absorb the hydraulic shock waves generated by the next release of pressurized gas. Additionally, the succession of pressure pulses may last anywhere from between 16 and 56 hours, and preferably last between about 20 and 48 hours. The applicants have observed that extending the succession of pressure pulses beyond 24 hours almost always has the effect of dislodging and removing significant additional amounts of sludge and debris from the interior of the secondary side.

In one preferred method of the invention, the secondary side of the steam generator is gradually filled with water over a selected period of time until the upper support plates are completely submerged. However, the generation of pressure pulses preferably commences when the water level submerges only the tubesheet, the lower portions of the heat exchanger tubes, and the opening of the pulse generator and continues during the filling of the secondary side up to a level beyond the upper support plate. At the same time, the water within the secondary side is recirculated through both a filtration unit to remove particulate matter and a demineralizer bed to remove ionic species therefrom. The removal of particulate matter during the cleaning process helps to prevent fine particulate matter from settling in the tubesheet crevice regions. To facilitate such particulate removal, a peripheral flow is induced in the water in the secondary side during recirculation. The removal of the ionic species prevents these chemicals from later precipitating out within the interior of the secondary side after the termination of the cleaning method. After the secondary side has been completely filled, the water continues to be recirculated through the demineralizer bed for a selected period of time, whereupon the water is gradually drained therefrom. The succession of pressure pulses preferably continues during both the recirculation and the draining steps.

Where the secondary sides of two or more nuclear steam generators are to be cleaned in the same facility, the water drained from the first steam generator cleaned is preferably used to fill a second steam generator. This is feasible since the water being drained from the first generator has been polished and filtered by the constant recirculation of this water through both a filtration unit and a demineralizer bed. The direct draining of such water from a first steam generator into a second steam generator that also needs cleaning not only minimizes the time required to clean both generators, but further conserves the amount of demineralized and polished water necessary to implement such cleaning.

In implementing the method of the invention, two of the pressure pulse generators are preferably positioned on opposite sides of the interior of the secondary side. While the pulses are preferably generated synchronously, they may also be generated asynchronously with respect to one another so that they will impinge off-center with respect to the tubesheet. The applicants believe that such off-center or asymmetrical shock wave impingement geometry may facilitate the cleaning in instances where it is not possible to mount the pressure pulsers in opposition to one another.

BRIEF DESCRIPTION OF THE SEVERAL FIGURES

FIG. 4A is a plan view of a portion of a different type of support plate and tubing wherein trifoil broaching is used in lieu of circular bores;

FIG. 4B is a perspective view of the portion of the support plate and tubing illustrated in FIG. 4A;

DETAILED DESCRIPTION OF THE PREFERRED EMBODIMENT

General Overview of the Application of the Invention

Figure 1:
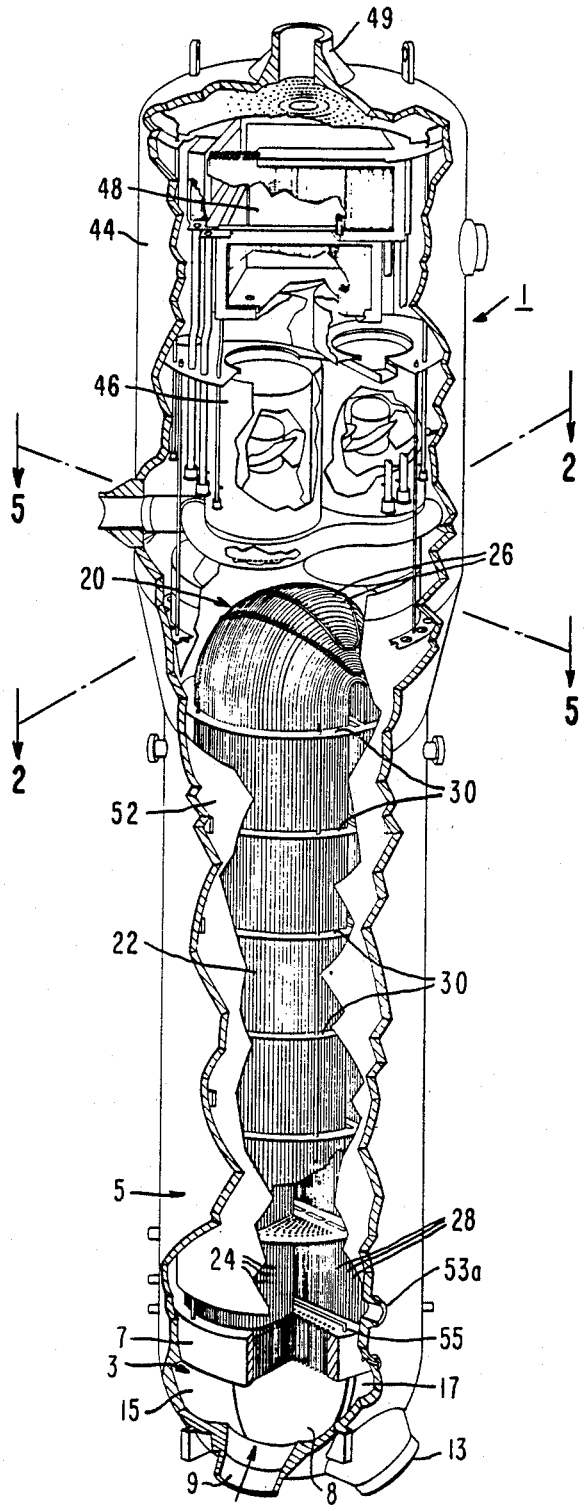
FIG. 1 is a perspective view of a Westinghouse-type nuclear steam generator with portions of the exterior walls removed so that the interiors of both the primary and secondary sides may be seen.
Figure 2:
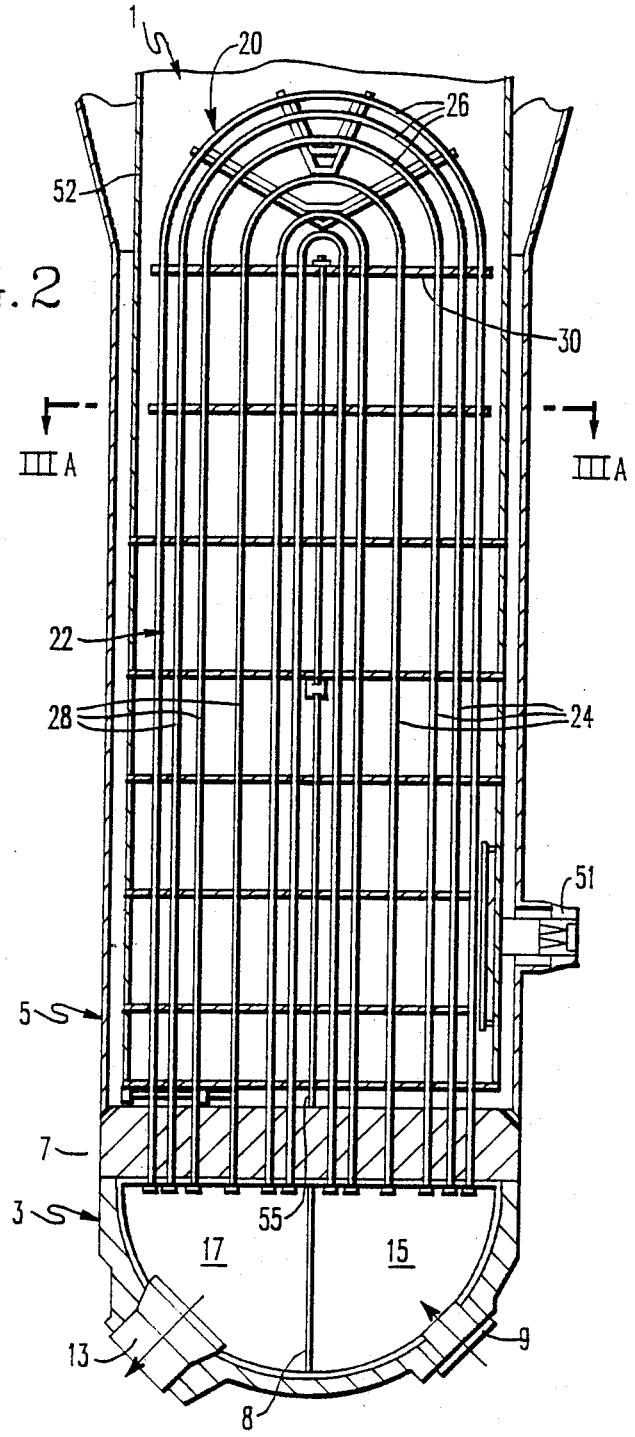
FIG. 2 is a partial cross-sectional side view of the steam generator illustrated in FIG. 1 along the line 2—2.
Figure 3A:
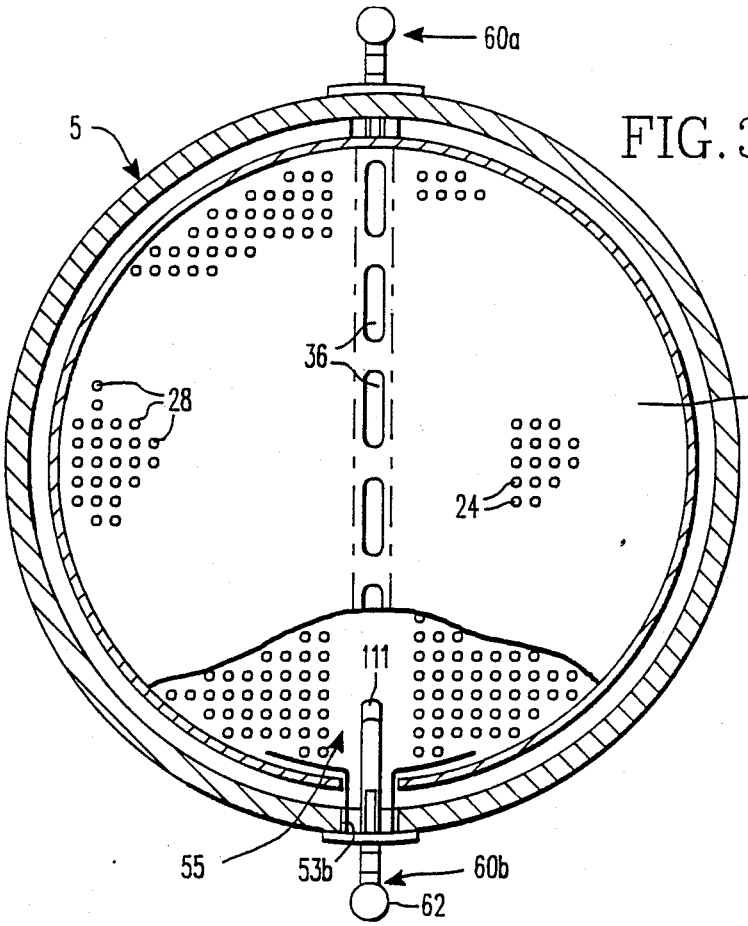
FIG. 3A is a cross-sectional plan view of the steam generator illustrated in FIG. 2 along the line 3A—3A.
Figure 3B:
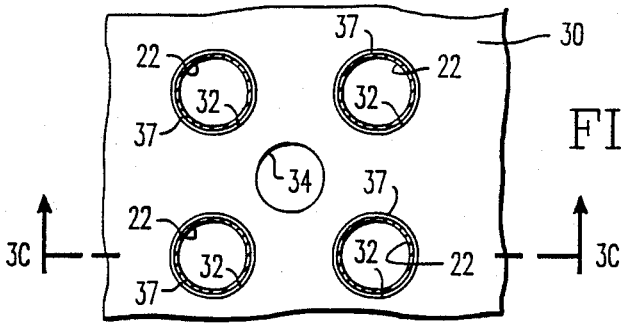
FIG. 3B is an enlarged view of the area circled in FIG. 3A.
Figure 3C:
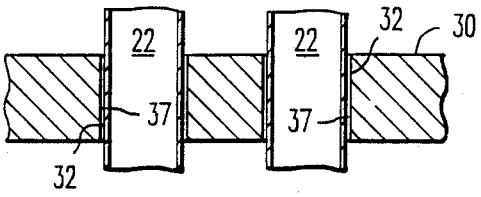
FIG. 3C is a cross-sectional side view of the portion of the support plate and heat exchanger tubing illustrated in FIG. 3B along the line 3C—3C.

With reference now to FIGS. 1 and 2, wherein like numerals designate like components throughout all of the several figures, the apparatus and method of the invention are both particularly adapted for removing sludge which accumulates within a nuclear steam generator 1. But before the application of the invention can be fully appreciated, some understanding of the general structure and maintenance problems associated with such steam generators 1 is necessary.

Nuclear steam generators 1 generally include a primary side 3 and a secondary side 5 which are hydraulically isolated from one another by a tubesheet 7. The primary side 3 is bowl-shaped, and is divided into two, hydraulically isolated halves by means of a divider plate 8. One of the halves of the primary side 3 includes a water inlet 9 for receiving hot, radioactive water that has been circulated through the core barrel of a nuclear reactor (not shown), while the other half includes a water outlet 13 for discharging this water back to the core barrel. This hot, radioactive water circulates through the U-shaped heat exchanger tubes 22 contained within the secondary side 5 of the steam generator 1 from the inlet half of the primary side 3 to the outlet half (see flow arrows). In the art, the water-receiving half of the primary side 3 is called the inlet channel head 15, while the water-discharging half is called the outlet channel head 17.

The secondary side 5 of the steam generator 1 includes an elongated tube bundle 20 formed from approximately 3500 U-shaped heat exchanger tubes 22. Each of the heat exchanger tubes 22 includes a hot leg, a U-bend 26 at its top, and a cold leg 28. The bottom end of the hot and cold legs 24, 28 of each heat exchanger tube 22 is securely mounted within bores in the tubesheet 7, and each of these legs terminates in an open end. The open ends of all the hot legs 24 communicate with the inlet channel head 15, while the open ends of all of the cold legs 28 communicate with the outlet channel head 17. As will be better understood presently, heat from the water in the primary side 3 circulating within the U-shaped heat exchanger tubes 22 is transferred to nonradioactive feed water in the secondary side 5 of the generator 1 in order to generate nonradioactive steam.

With reference now to FIGS. 2, 3A, 3B and 3C, support plates 30 are provided to securely mount and uniformly space the heat exchanger tubes 22 within the secondary side 5. Each of the support plates 30 includes a plurality of bores 32 which are only slightly larger than the outer diameter of the heat exchanger tubes 22 extending therethrough. To facilitate a vertically-oriented circulation of the nonradioactive water within the secondary side 5, a plurality of circulation ports 35 is also provided in each of the support plates 30. Small annular spaces or crevices 37 exist between the outer surface of the heat exchanger tubes 22, and the inner surface of the bores 32. Although not specifically shown in any of the several figures, similar annular crevices 37 exist between the lower ends of both the hot and cold legs 24 and 28 of each of the heat exchanger tubes 22, and the bores of the tubesheet 7 in which they are mounted. In some types of nuclear steam generators, the openings in the support plates 30 are not circular, but instead are trifoil or quatrefoil-shaped as is illustrated in FIGS. 4A and 4B. In such support plates 30, the heat exchanger tubes 22 are supported along either three or four equidistally spaced points around their circumferences. Because such broached openings 38 leave relatively large gaps 40 at some points between the heat exchanger tubes 22 and the support plate 30, there is no need for separate circulation ports 34.

With reference back to FIGS. 1 and 2, the top portion of the secondary side 5 of the steam generator 1 includes a steam drying assembly 44 for extracting the water out of the wet steam produced when the heat exchanger tubes 22 boil the nonradioactive water within the secondary side 5. The steam drying assembly 44 includes a primary separator bank 46 formed from a battery of swirl vane separators, as well as a secondary separator bank 48 that includes a configuration of vanes that define a tortuous path for moisture-laden steam to pass through. A steam outlet 49 is provided over the steam drying assembly 44 for conducting dried steam to the blades of a turbine coupled to an electrical generator. In the middle of the lower portions of the secondary side 5, a tube wrapper 52 is provided between the tube bundle 22 in the outer shell of the steam generator 1 in order to provide a down comer path for water extracted from the wet steam that rises through the steam drying assembly 44.

At the lower portion of the secondary side 5, a pair of opposing sludge lance ports 53*a*, 53*b* are provided in some models of steam generators to provide access for high pressure hoses that wash away much of the sludge which accumulates over the top of the tubesheets 7 during the operation of the generator 1. These opposing sludge lance ports 53*a*, 53*b* are typically centrally aligned between the hot and cold legs 24 and 28 of each of the heat exchanger tubes 22. It should be noted that in some steam generators, the sludge lance ports are not oppositely disposed 180 degrees from one another, but are only 90 degrees apart. Moreover, in other steam generators, only one such sludge lance port is provided. In the steam generator arts, the elongated areas between rows of tubes 22 on the tubesheet 7 are known as tube lanes 54, while the relatively wider, elongated area between the hot and cold legs of the most centrally-disposed heat exchanger tubes 22 is known as the central tube lane 55. These tube lines 54 are typically an inch or two wide in steam generators whose tubes 27 are arranged in a square pitch, such as that shown in FIGS. 3A, 3B and 3C. Narrower tube lanes 54 are present in steam generators whose heat exchanger tubes 22 are arranged in a denser, triangular pitch such as shown in FIGS. 4A and 4B.

During the operation of such steam generators 1, it has been observed that the inability of secondary-side water to circulate as freely in the narrow crevices 37 or gaps 40 between the heat exchanger tubes 22, and the support plates 30 and tubesheets 7 can cause the non-radioactive water in these regions to boil completely out of these small spaces, a phenomenon which is known as "dry boiling." When such dry boiling occurs, any impurities in the secondary side water are deposited in these narrow crevices 37 or gaps 38. Such solid deposits tend to impede the already limited circulation of secondary side water through these crevices 37 and gaps 38 even more, thereby promoting even more dry boiling. This generates even more deposits in these regions and is one of the primary mechanisms for the generation of sludge which accumulates over the top of the tubesheet 7. Often the deposits created by such dry boiling are formed from relatively hard compounds of limited solubility, such as magnitite, which tends to stubbornly lock itself in such small crevices 37 and gaps 38. These deposits have been known to wedge themselves so tightly in the crevices 37 or gaps 38 between the heat exchanger tubes 22 and the bores 32 of the support plates 30 that the tube 22 can actually become dented at this region.

The instant invention is both an apparatus and a method for dislodging and loosening such deposits, sludge and debris and completely removing them from the secondary side 5 of a steam generator 1.

Apparatus of the Invention

With reference now to FIGS. 5, 6A, 6B, 7 and 8 the apparatus of the invention generally comprises a pair of pressure pulse generator assemblies 60*a*, 60*b* mounted in the two sludge lance ports 53*a*, 53*b*, in combination with a recirculation system 114. Because both of these generator assemblies 60*a*, 60*b* are identical in all respects, the following description will be confined to generator assembly 60*b* in order to avoid unnecessary prolixity.

Figure 6A:
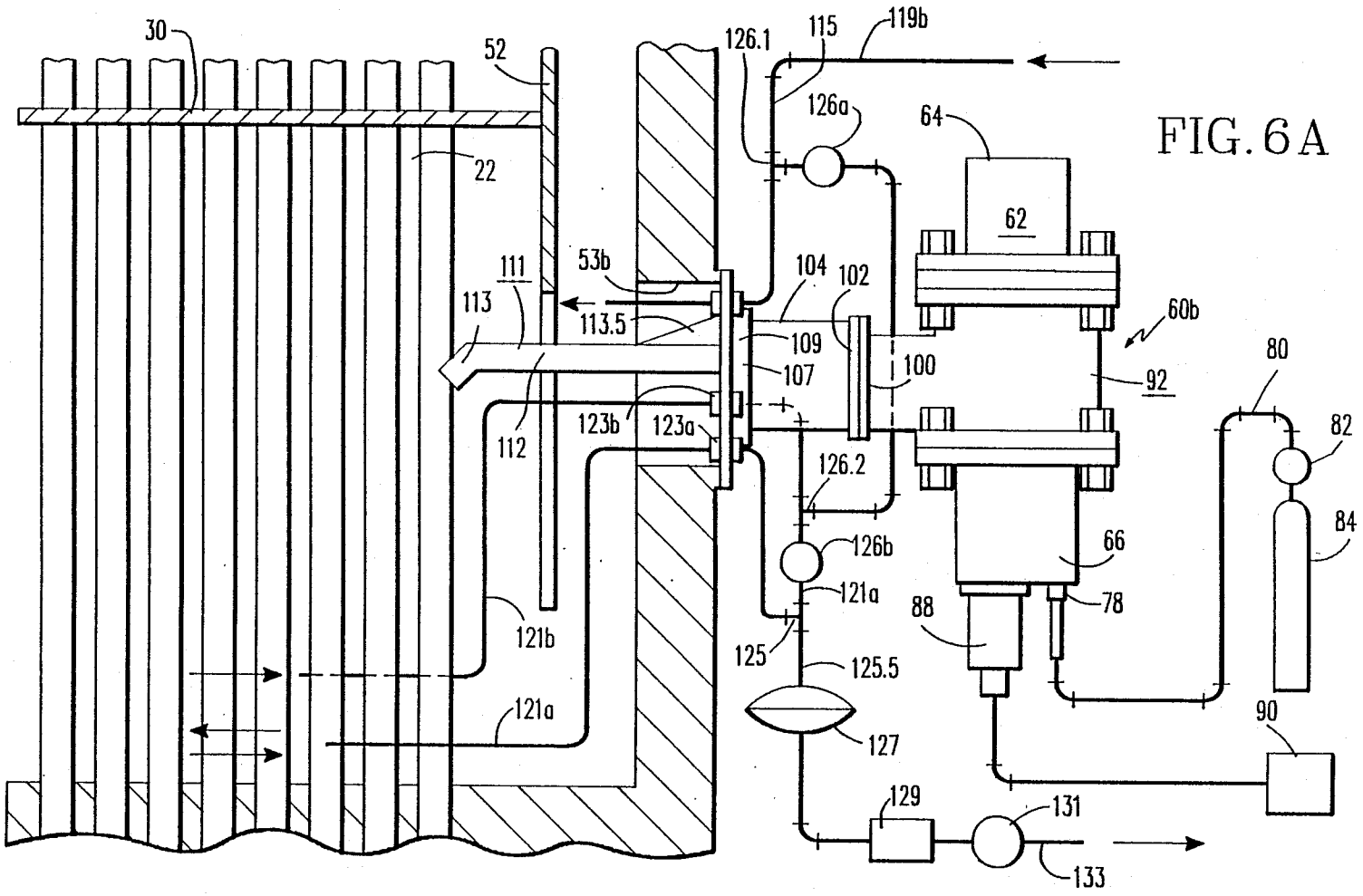
FIG. 6A is an enlarged view of the circled portion of FIG. 5 along with a schematized representation of the pressurized gas source used to power the pressure pulse generator assemblies.
Figure 6B:
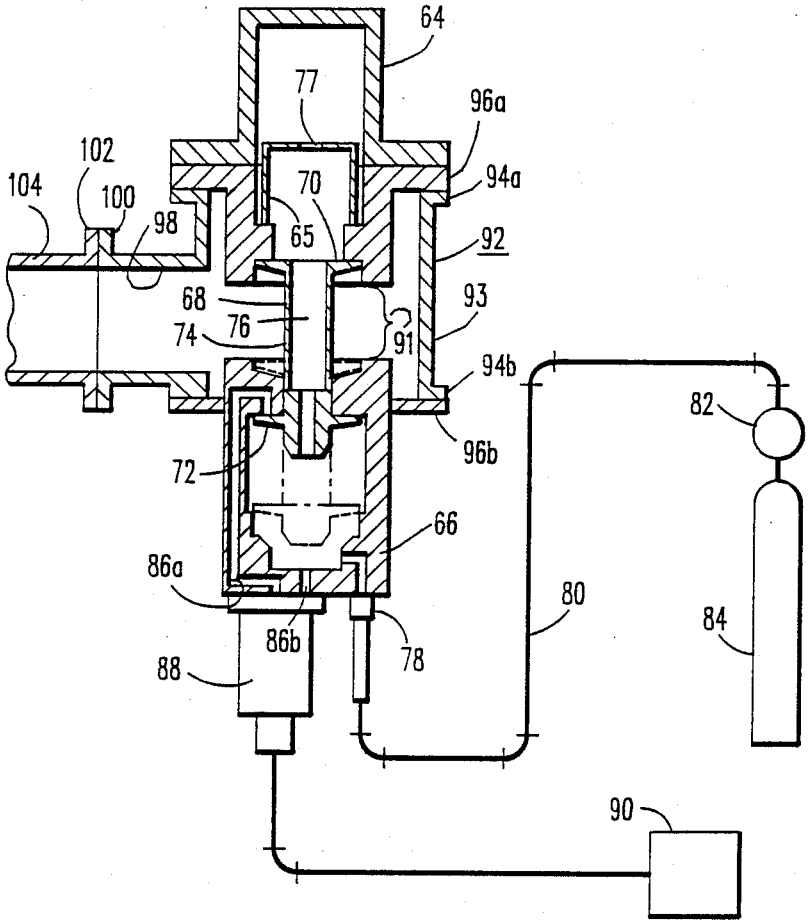
FIG. 6B is a cross-sectional side view of the air gun used in each of the pressure pulse generator assemblies of the invention.

With specific reference to FIGS. 6A and 6B, pulse generator assembly 60*b* includes an air gun 62 for instantaneously releasing a volume of pressurized gas, and a single port manifold 92 for directing this pressurized gas into a generally tubular nozzle 111 which is aligned along the central tube lane 55 of the steam generator 1. The air gun 62 includes a firing cylinder 64 that contains a pulse flattener 65 which together are dimensioned to store about 88 cubic inches of pressurized gas. Air gun 62 further includes a trigger cylinder 66 which stores approximately 10 cubic inches of pressurized gas, and a plunger assembly 68 having an upper piston 70 and a lower piston 72 interconnected by means of a common connecting rod 74. The upper piston 70 can selectively open and close the firing cylinder 64, and the lower piston 72 is reciprocally movable within the trigger cylinder 66 as is indicated in phantom. The area of the lower piston 72 that is acted on by pressurized gas in trigger cylinder 66 is greater than the area of the upper piston 70 acted on by pressurized gas in the cylinder 64. The connecting rod 74 of the plunger 68 includes a centrally disposed bore 76 for conducting pressurized gas admitted into the trigger cylinder 66 into the firing cylinder 64. The pulse flattener 65 also includes a gas conducting bore 77 that is about 0.50 inches in diameter. Pressurized gas is admitted into the trigger cylinder 66 by means of a coupling 78 of a gas line 80 that is connected to a pressurized tank of nitrogen 84 by way of a commercially available pressure regulator 82. Gas conducting bores 86*a* and 86*b* are further provided in the walls of the trigger cylinder 66 between a solenoid operated valve 88 and the interior of the cylinder 66. The actuation of the solenoid operated valve 88 is controlled by means of an electronic firing circuit 90.

In operation, pressurized gas of anywhere between 200 and 1600 psi is admitted into the trigger cylinder 66 by way of gas line 80. The pressure that this gas applies to the face of the lower piston 72 of the plunger 68 causes the plunger 68 to assume the position illustrated in FIG. 6B, wherein the upper piston 70 sealingly engages the bottom edge of the firing cylinder 64. The sealing engagement between the piston 70 and firing cylinder 64 allows the firing cylinder 64 to be charged with pressurized gas that is conducted from the trigger cylinder 66 by way of bore 76 in the connecting rod 74, which in turn flows through the gas-conducting bore 77 in the pulse flattener 65. Such sealing engagement between the upper piston 70 and the firing cylinder 64 will be maintained throughout the entire charging period since the area of the lower piston 72 is larger than the area of the upper piston 70. After the firing cylinder 64 has been completely charged with pressurized gas between 200 and 1600 psi, the pressure pulse generator 60*b* is actuated by firing circuit 90, which opens solenoid valve 88 and exposes gas passages 86*a* and 86*b* to the ambient atmosphere. The resulting escape of pressurized gas from the trigger cylinder 66 creates a disequilibrium in the pressures acting upon the lower and upper pistons 70, 72 of the plunger 68, causing it to assume the position illustrated in phantom in less than a millisecond. When the air gun 62 is thus fired, 10 cubic inches of pressurized gas are emitted around the 360 degree gap 91 between the lower edge of the firing cylinder 64 and the upper edge of the trigger cylinder 66, while the remaining 77 cubic inches follows 2 or 3 milliseconds later through the gas conducting bore 77 of the pulse flattener 65. The two-stage emission of pressurized air out of firing cylinder 64 lowers the peak amplitude of the resulting shock wave in the secondary side, thereby advantageously lowering the peak stress experienced by the heat exchanger tubes 22 in the vicinity of the nozzle 111. In the preferred embodiment, air gun 62 is a PAR 600B air gun manufactured by Bolt Technology, Inc., located in Norwalk, Conn., and firing circuit 90 is a Model FC100 controller manufactured by the same corporate entity.

The single port manifold 92 completely encloses the circumferential gap 91 of the air gun 62 that vents the pressurized gas from the firing cylinder 64. Upper and lower mounting flanges 94*a*, 94*b* are provided which are sealingly bolted to upper and lower mounting flanges 96*a*, 96*b* that circumscribe the cylinders 64, 66 of the air gun 62. The manifold 92 has a single outlet port 98 for directing the pulse of pressurized gas generated by the air gun 62 into the nozzle 111. This port 98 terminates in a mounting flange 100 which is bolted onto one of the annular shoulders 102 of a tubular spool piece 104. The other annular shoulder 107 of the spool piece 104 is bolted around a circular port (not shown) of a mounting flange 109. The spool piece 104 and outlet port 98 are sufficiently long so that the body of the air gun 62 is spaced completely out of contact with the shell of the steam generator 1. This is important, as such spacing prevents the hard outer shell of the air gun 62 from vibrating against the shell of the generator 1 when it is fired. In the preferred embodiment, both the single port manifold 92 and spool piece 104 are formed from stainless steel approximately 0.50 inches thick to insure adequate strength. The mounting flange 109 is also preferably formed from 0.50 thick stainless steel, and has a series of bolt holes uniformly spaced around its circumference which register with bolt receiving holes (not shown) normally present around the sludge lance port 52*b* of the steam generator 1. Hence, the pulse generator assembly 62*b* can be mounted onto the secondary side 5 of the steam generator without the need for boring special holes in the generator shell.

Figure 7:
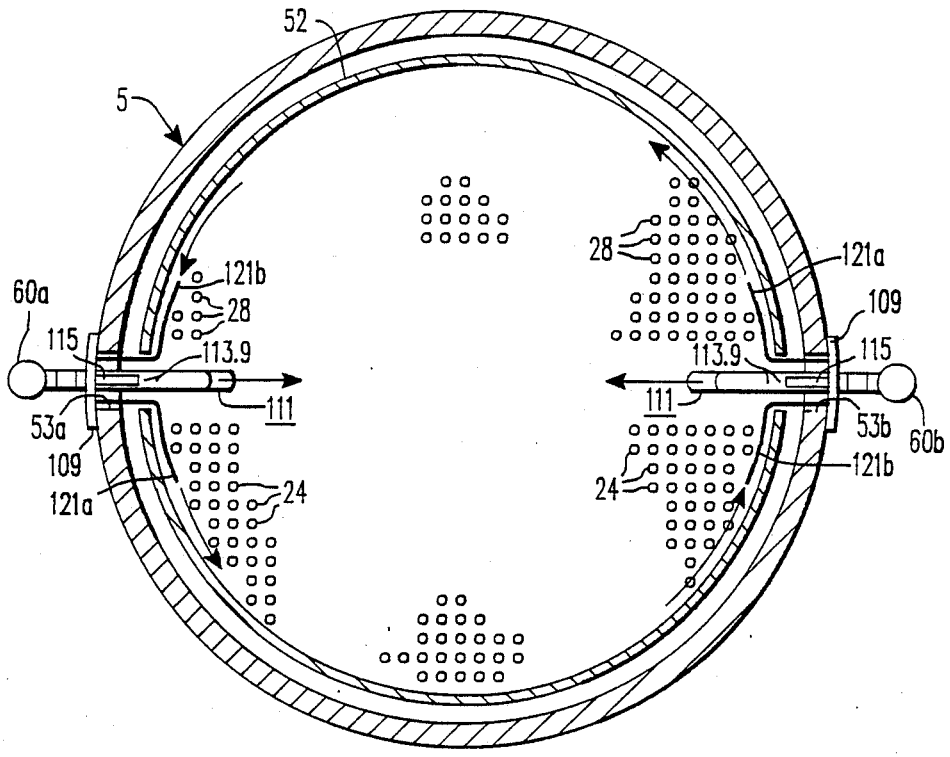
FIG. 7 is a plan view of the steam generator illustrated in FIG. 5 along the line 7—7.

The nozzle 111 of the pressure pulse generator assembly 60*b* includes a tubular body 112. One end of the tubular body 112 is circumferentially welded around the port (not shown) of the mounting flange 109 so that all of the compressed air emitted through the outlet port 98 of the single port manifold 92 is directed through the nozzle 111. A complete-penetration weld is used to insure adequate strength. The other end of the tubular body 112 is welded onto a tip portion 113 which is canted 30 degrees with respect to the upper surface of the tubesheet 7. Because the 30 degree orientation of the tip portion 113 induces an upwardly directed movement along the nozzle 111 when the pulse generator 60*b* is fired, a gusset 113.5 is provided between the tubular body 112 of the nozzle and mounting flange 109. In the preferred embodiment, the body 112 of the nozzle 111 is formed from stainless steel about 0.50 thick, having inner and outer diameters of 2.0 and 2.5 inches, respectively. The nozzle 111 is preferably between 20 and 24 inches long, depending on the model of steam generator 1. In all cases, the tip portion 113 should extend beyond the tube wrapper 52. Finally, two vent holes 113.9 that are 0.25 inches in diameter and 1.0 inch apart are provided on the upper side of the tubular body 112 of the nozzle 111 to expedite the refilling of the nozzle 111 with water after each firing of the air gun 62 (as shown in FIG. 7). The provision of such vent holes 113.9 does not divert any significant portion of the air and water blast from the air gun 62 upwardly.

It has been found that a 30 degree downward inclination of the tip portion 113 is significantly more effective than either a straight, pipe-like nozzle configuration that is horizontal with respect to the tubesheet 7, or an elbow-like configuration where the tip 113 is vertically disposed over the tubesheet 7. Applicant believes that the greater efficiency associated with the 30 degree orientation of the nozzle tip 113 results from the fact that the blast of water and pressurized air emitted through the nozzle 111 obliquely hits a broad, near-center section of the tubesheet 7, which in turn advantageously reflects the shock wave upwardly toward the support plates 30 and over a broad cross-section of the secondary side. This effect seems to be complemented by the simultaneous, symmetrical blast of air and water from the pulse generator 60*a* located 180 degrees opposite from pulse generator 60*b*. The symmetrical and centrally oriented impingement of the two shock waves seems to create a uniform displacement of water in the upper portion of the secondary side 5, as may be best understood with reference to FIG. 5. This is an important advantage as one of the primary cleaning mechanisms at work in the upper regions of the secondary side 5 of the steam generator seems to be the near instantaneous and uniform vertical displacement of the water from 0.25 to 60*a*, 60*b*. Still another important advantage associated with the oblique orientation of the blast of air and water is that the peak stress on the heat exchanger tubes 22 in the vicinity of the tip 113 is lowered. By contrast, if the nozzle tip 113 were directed completely horizontally, no part of the blast would be widely reflected upwardly, and the force of the air and water blast would act orthogonally on the nearest tube 22. Similarly, if the blast were directed completely vertically toward the tubesheet 7, the impact area of the blast against the tubesheet would be narrower, and peak tube stresses would again be higher as the blast would be more concentrated.

Figure 8:
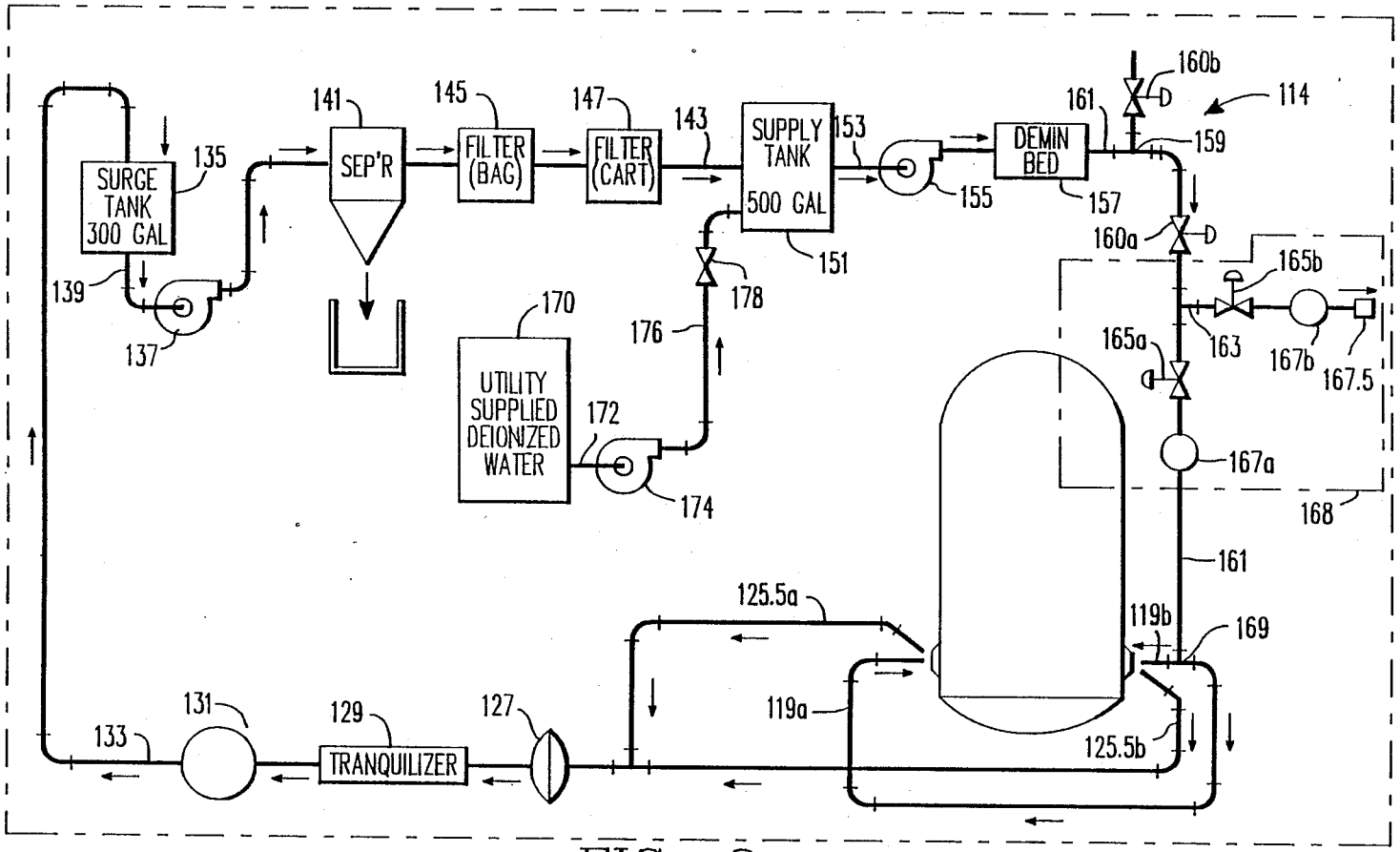
FIG. 8 is a schematic view of the recirculation system used to implement the method of the invention.

With reference now to FIGS. 6A, 7 and 8, the apparatus of the invention further includes a recirculation system 114 that is interconnected with the pressure pulse generator assembly 60*b* by inlet hose 115, a suction-inlet hose 121*a*, and a suction hose 121*b*. As is best seen in FIG. 6A, inlet hose 115 extends through the circular mounting flange 109 of the pressure pulse generator assembly 60*b* by way of a fitting 117. At its distal end, the inlet hose 115 is aligned along the main tube lane 55 above nozzle 111 as is best seen in FIG. 7. At its proximal end, the inlet hose 115 is connected to an inlet conduit 119*b* that is part of the recirculation system 114. Suction-inlet hose 121*a* and suction hose 121*b* likewise extend through the mounting flange 109 by way of fittings 123*a*, 123*b*. Inlet hose 115 is provided with a diverter valve 126*a* connected thereto by a T-joint 126.1 for diverting incoming water into suction-inlet hose 121*a* as shown. Suction-inlet hose 121*a* includes an isolation valve 126*b* as shown just below T-joint 126.2. When suction-inlet hose 121*a* is used as a suction hose, valves 126*a* and 126*b* are closed and opened, respectively. When suction-inlet hose 121*b* is used as an inlet hose, valves 126*a* and 126*b* are opened and closed, respectively.

The distal ends of the hoses 121*a*, 121*b* lie on top of the tubesheet 7, and are aligned along the circumference of the tubesheet 7 in opposite directions, as may best be seen in FIG. 7. Such an alignment of the inlet hose 115 and hoses 121*a*, 121*b* helps induce a circumferential flow of water around the tubesheet 7 when hose 121*a* is used as an inlet hose by shutting valve 126*b* and opening valve 126*a*. As will be discussed later, such a circumferential flow advantageously helps to maintain loosened sludge in suspension while the water in the secondary side is being recirculated through the particulate filters 145 and 147 of the recirculation system 114. The proximal ends of each of the hoses 121*a*, 121*b* are connected to the inlet ends of a T-joint 125. The outlet end of the T-joint 125 is in turn connected to the inlet of a diaphragm pump 127 by way of conduit 125.5*b*. The use of a diaphragm-type pump 127 is preferred at this point in the recirculation system 114 since the water withdrawn through the hoses 121*a*, 121*b* may have large particles of suspended sludge which, while easily handled by a diaphragm-type pump, could damage or even destroy a rotary or positive displacement-type pump.

FIG. 8 schematically illustrates the balance of the recirculation system 114. The suction-inlet hose 121*a* and suction hose 121*b* of each of the pressure pulse generator assemblies 60*a*, 60*b* are ultimately connected to the input of diaphragm pump 127. The output of the diaphragm pump 127 is in turn serially connected to first a tranquilizer 129 and then a flow meter 131. The tranquilizer 129 "evens out" the pulsations of water created by the diaphragm pump 127 and thus allows the flow meter 131 to display the average rate of the water flow out of the diaphragm pump 127. The output of the flow meter 131 is connected to the inlet of a surge tank 135 via conduit 133. In the preferred embodiment, the surge tank 135 has an approximately 300 gallon capacity. The outlet of the surge tank 135 is connected to the inlet of a flow pump 137 by way of a single conduit 139, while the output of the pump 137 is connected to the inlet of a cyclone separator 141 via conduit 143. In operation, the surge tank accumulates the flow of water generated by the diaphragm pump 127 and smoothly delivers this water to the inlet of the pump 137. The pump 137 in turn generates a sufficient pressure head in the recirculating water so that a substantial portion of the sludge suspended in the water will be centrifugally flung out of the water as it flows through the cyclone separator 141.

Located downstream of the cyclone separator 141 is a one to three micron bag filter 145 that is serially connected to a one micron cartridge filter 147. These filters 145 and 147 remove any small particulate matter which still might be suspended in the water after it passes through the cyclone separator 141. Downstream of the filters 145 and 147 is a 500 gallon supply tank 151. Supply tank 151 includes an outlet conduit 153 that leads to the inlet of another flow pump 155. The outlet of the flow pump 155 is in turn connected to the inlet of a dimineralizer bed 157. The purpose of the flow pump 155 is to establish enough pressure in the water so that it flows through the serially connected ion exchange columns (not shown) in the demineralizer bed 157 at an acceptably rapid flow rate. The purpose of the demineralizer bed 157 is to remove all ionic species from the water so that they will have no opportunity to reenter the secondary side 5 of the generator 1 and create new sludge deposits.

Located downsteam of the demineralizer bed 157 is a first T-joint 159 whose inlet is connected to conduit 161 as shown. An isolation valve 160*a* and a drain valve 160*b* are located downstream of the two outlets of the T-joint 159 as shown to allow the water used in the cleaning method to be drained into the decontamination facility of the utility. Located downstream of the T-joint 159 is another T-joint 163 whose inlet is also connected to conduit 161 as shown. Diverter valves 165*a* and 165*b* are located downstream of the outlet of T-joint 163 as indicated. Normally valve 165*a* is open and valve 165*b* is closed. However, if one desires to fill a second steam generator 1 with the filtered and polished water drained from a first steam generator in order to expedite the pressure pulse cleaning method, valves 165*a* and 165*b* can be partially closed and partially opened, respectively. Flowmeters 167*a*, 167*b* are located downstream of the valves 165*a* and 165*b* so that an appropriate bifurcation of the flow from conduit 161 can be had to effect such a simultaneous drain-fill step. Additionally, the conduit that valve 165*b* and flowmeter 167*b* are mounted in terminates in a quick connect coupling 167.5. To expedite such a simultaneous drain-fill step, valves 165*a* and 165*b* are mounted on a wheeled cast (not shown) and conduit 161 is formed from a flexible hose to form a portable coupling station 168. Downstream of the portable coupling station 168, inlet conduit 161 terminates in the inlet of a T-joint 169 that bifurcates the inlet flow of water between inlet conduits 119*a* and 119*b*.

Water is supplied through the recirculation system 114 through deionized water supply 170, which may be the deionized water reservoir of the utility being serviced. Water supply 170 includes an outlet conduit 172 connected to the inlet of another flow pump 174. The outlet of the flow pump 174 is connected to another conduit 176 whose outlet is in turn connected to the supply tank 151. A check valve 178 is provided in conduit 176 to insure that water from the supply tank 151 cannot back up into the deionized water reservoir 170.

Method of the Invention

Figure 5:
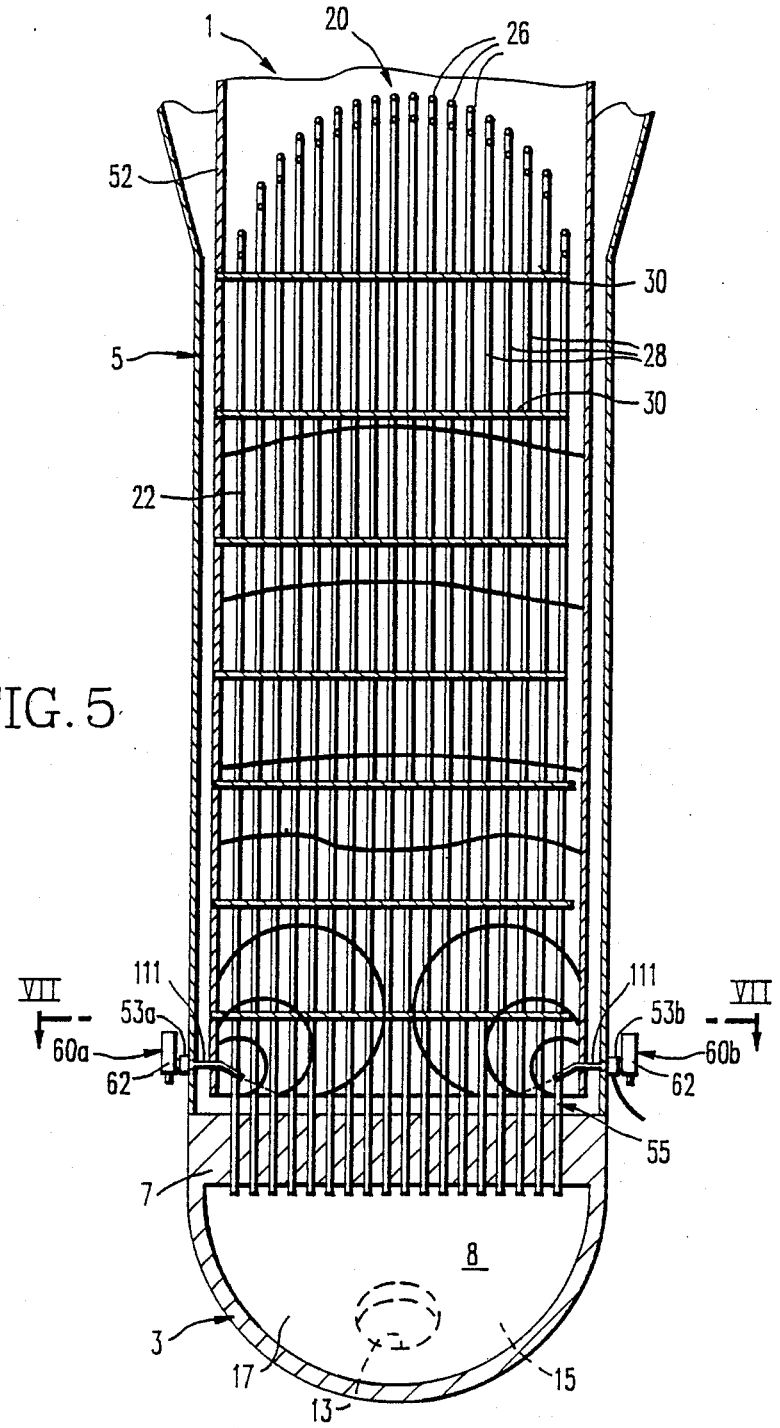
FIG. 5 is a cross-sectional side view of the steam generator illustrated in FIG. 1 along the line 5—5.

With reference now to FIGS. 5, 6A and 6B, the method of the invention is generally implemented by the previously described pressure pulse generator assemblies 60*a*, 60*b* in combination with the recirculation system 114. However, before these components of the apparatus of the invention are installed in and operated in a steam generator 1, several preliminary steps are carried out. In the first of these steps, the relative condition of the heat exchanger tubes 22 is preferably ascertained by an eddy current or ultrasonic inspection of a type well known in the art. Such an inspection will give the system operators information which they can use to infer the maximum amount of momentary pressures that the tubes 22 of a particular steam generator can safely withstand without any danger of yielding or without undergoing significant metal fatigue. In this regard, applicants have observed that heat exchanger tubes 22 in moderately good condition can withstand momentary pressures of up to approximately 19 ksi without yielding or without incurring significant amounts of metal fatigue. By contrast, it is anticipated that relatively old heat exchanger tubes 22 whose walls have been significantly weakened by corrosion and fretting may only be able to withstand only 15 ksi, while relatively new tubes which are relatively free of the adverse affects of corrosion or fretting may be able to withstand up to 30 ksi without any adverse mechanical effects.

After the tubes 22 have been inspected by an eddy current or ultrasonic probe to the extent necessary to ascertain the maximum amount of momentary pressure they can safely withstand, the secondary side 5 of the steam generator 1 is drained and all loose sludge that accumulates on top of the tube sheet 7 is removed by known methods, such as flushing or by sludge lancing. In the preferred embodiment, sludge lancing techniques such as those disclosed and claimed in U.S. Pat. Nos. 4,079,701 and 4,676,201 are used, each of which is owned by the Westinghouse Electric Corporation. Generally speaking, such sludge lancing techniques involve the installation of a movable water nozzle in the sludge lance ports 53*a*, 53*b* in the secondary side 5 which washes the loose sludge out of the generator 1 by directing a high velocity stream of water down the tube lanes 54.

After all of the loose sludge on top of the tubesheet 7 has thus been removed, the pressure pulse generator assemblies 60*a*, 60*b* are installed in the sludge lance ports 53*a*, 53*b* in the positions illustrated in the FIGS. 6A and 7. Specifically, the tubular body 112 of the nozzle 111 of each of the generator assemblies 60*a*, 60*b* is centrally aligned along the main tube lane 55 in a horizontal position as shown so that the canted nozzle tip 113 assumes a 30 degree orientation with respect to the flat, horizontal upper surface of the tubesheet 7. Next, the recirculation system 114 is connected to each of the pulse generator assemblies 60*a*, 60*b* by coupling the inlet hose 115 of each to the flexible inlet conduits 119*a* and 119*b*, and the suction-inlet hose 121*a* and suction hose 121*b* of each to flexible suction conduits 125.5*a*, 125.5*b* via the T-joint 125 of each assembly 60*a*, 60*b*. Next, the recirculation system 114 is connected via conduit 172 to the supply 170 of deionized water from the utility, as is best seen in FIG. 8. The flow pump 174 is then actuated in order to fill supply tank 151 approximately one-half full, which will occur when tank 151 receives about 250 gallons of water.

Once supply tank 151 is at least one-half full, flow pump 155 is actuated to commence the fill cycle. In the preferred method of the invention, pump 155 generates a flow of purified water of approximately 120 gallons per minute which is bifurcated to two 60 gallon per minute flows at T-joint 169 between inlet hose 119*a* and 119*b* on opposing sides of the generator 1 in order to fill the secondary side 5 of the steam generator 1. During the time that the secondary side 5 is being filled via pump 153, valves 165*a* and 165*b* are opened and closed so that the entire flow of water from pump 153 enters the generator 1. Additionally, valves 126*a*, 126*b* are opened and closed in each of the generator assemblies 60*a*, 60*b* in order to further bifurcate the 60 gallon per minute flow from inlet conduit 119*a*, 119*b* between the inlet hose 115 and the suction-inlet hose 121*a* of each of the generator assemblies 60*a*, 60*b*. As soon as the water level on the secondary side 5 becomes great enough to submerge both hoses 121*a*, 121*b* diaphragm pump 127 is actuated and adjusted to withdraw 50 gallons per minute a piece out of the secondary side 5. Since the flow pump 155 introduces 120 gallons per minute, while the diaphragm pump 127 withdraws 50 gallons per minute, the secondary side 5 is filled at a net flow rate of 70 gallons per minute. Additionally, since the suction-inlet hose 121*b* of each of the generator assemblies 60*a*, 60*b* is used at this time as a fill hose, whose output is circumferentially directed toward an opposing suction hose 121*a*, a peripheral flow of water is created around the circumference of the secondary side as is best seen in FIG. 7. Such a peripheral flow of water is believed to help keep in suspension the relatively large amounts of sludge and debris that are initially dislodged from the interior of the secondary side 5 when the generator assemblies 60*a*, 60*b* are actuated which in turn allows the recirculation system 114 to remove the maximum amount of dislodged sludge and debris during the fill cycle of the method.

After the water level in the secondary side 5 of the generator 1 rises to a level of at least six inches over the nozzles 111 of each of the pressure pulse generator assemblies 60*a*, 60*b*, the firing of the air gun 62 of each of the assemblies 60*a*, 60*b* commences. If the prior eddy current and ultrasonic testing indicates that the heat exchanger tubes 22 can withstand momentary pressures of approximately 19 ksi without any deleterious affects, the gas pressure regulators 82 of each of the generator assemblies 60*a*, 60*b* is adjusted so that gas of a pressure of about 400 psi is initially admitted into the firing cylinders 64 of the air gun 62 of each. Such a gas pressure applies a peak stress to the tubes 22 which is safely below the 19 ksi limit, as will be discussed in more detail hereinafter. The firing circuit 90 is then adjusted to fire the solenoid operated valve 88 of the trigger cylinder 66 every seven to ten seconds. The firing of the air gun 62 at seven to ten second intervals continues during the entire fill, recirculation and drain cycles of the method. While the generator assemblies 60*a*, 60*b* are capable of firing at shorter time intervals, a pulse firing frequency of seven to ten seconds is preferred because it gives the nitrogen gas emitted by the nozzle 111 sufficient time to clear the nozzle 111 and manifold 92 before the next pulse. If pockets of gas remain in the pulse generator 60*b* during subsequent air gun firings, then a significant amount of the shock to the water within the secondary side 5 would be absorbed by such bubbles, thereby interfering with the cleaning action.

It is important to note that the gas pressure initially selected for use with the pressure pulse generator assembly 60*a*, 60*b* induces momentary pressures that are well below the maximum safe amount of momentary forces that the tubes 22 can actually withstand, for two reasons. First, as will be discussed in more detail hereinafter, the pressure of the gas used in the generator assembly 60*a*, 60*b* is slowly raised in proportion with the extent to which the secondary side 5 of the steam generator 1 is filled until it is approximately twice as great as the initially chosen value for gas pressure. Hence, when the initial gas pressure used when the water level is just above the nozzles 111 is 400 psi, the final pressure of the gas used in the pressure pulse generator assembly 60*a*, 60*b* will be 800 to 900 psi. Secondly, the gas pressure is chosen so that the maximum pressure used will induce momentary forces in the tubes 22 which are at least 30 and preferably 40 percent below the maximum ksi indicated by the previously mentioned eddy current and ultrasonic inspection to provide a wide margin of safety. In making the selection of which gas pressures to use, applicants have discovered that there is a surprising, non-linear relationship between the pressure of the gas used in the air gun 62 of each pulse generator assembly 60*a*, 60*b* and the resulting peak stress on the tubes 22 as is evident from the following test results:

| Gas Pressure | Peak Tube Stress |
|---|---|
| 400 psi | 5,580 psi |
| 800 psi | 12,090 psi |
| 1600 psi | 30,960 psi |

In most circumstances, the firing of the air gun 62 of both the pulse generators will be synchronous in order to uniformly displace the water throughout the entire cross-section of the secondary side 5 of the generator 1.

However, there may be instances where an asynchronous firing of the air guns 62 of the different assemblies may be desirable, such as in a steam generator where the sludge lance ports 53*a*, 53*b* are only 90 degrees apart from one another. In such a case, the asynchronous firing of the air guns 62 could possibly help to compensate for the non-opposing arrangement of the pulse generators 60*a*, 60*b* in the secondary side 5 imposed by the location of the 90 degree apart sludge lance ports 53*a*, 53*b*.

Figure 9:
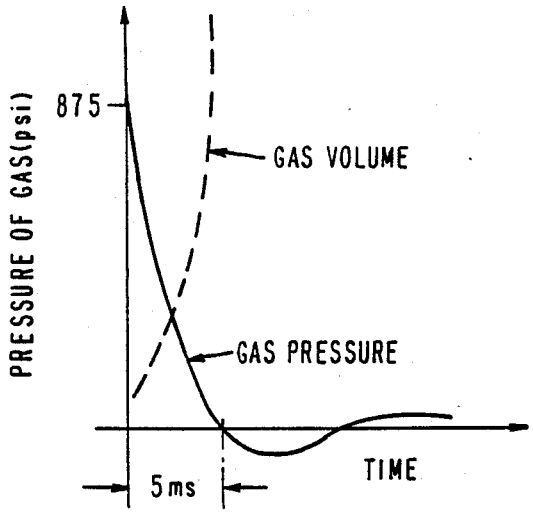
FIG. 9 is a graph illustrating the diminishment over time of the pressure of the gas within the pressure pulse generator after the pulse generator assembly is fired.
Figure 10:
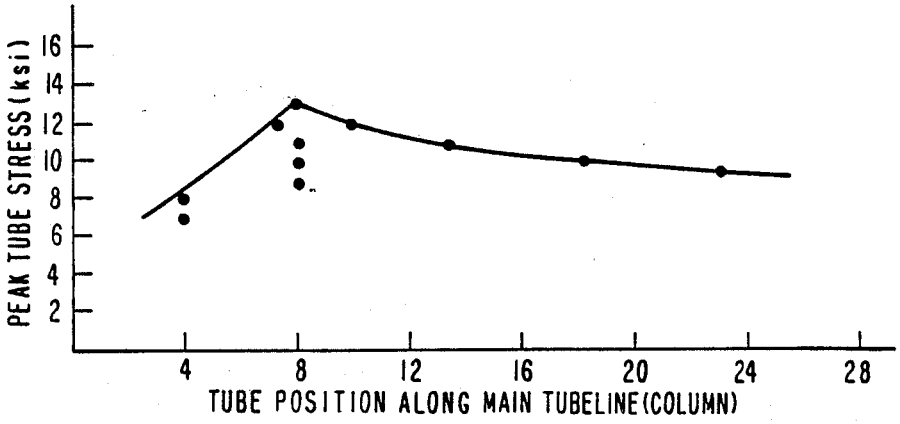
FIG. 10 is a graph illustrating the relationship between the maximum stress experienced by the heat exchanger tubes in the steam generator, and the location of these tubes with respect to the tubesheet.

FIG. 9 illustrates how the pressure of the gas within the 88 cubic inch firing cylinder 64 of the air gun 62 diminishes over time, and FIG. 10 indicates the peak stress experienced by the column of tubes closest to the nozzle 111. Specifically, when the pressure of the gas within the firing cylinder 64 is 875 psi, and a 10 cubic inch pulse flattener 65 having a gas-conducting bore 0.50 inches in diameter is used, the gas leaves the cylinder 62 over a time period of approximately five milliseconds. FIG. 10 shows that the peak stress experienced by the column of tubes 22 closest to the tip portion 113 of the nozzle 111 is between 12 and 13 ksi, which again is safely below the 19 ksi limit. If no pulse flattener 65 were used, the closest column of heat exchanger tubes 22 in the secondary side 5 to the tip portion 113 of the nozzle 111 would be considerably higher, as the gas would escape from the air gun in a considerably shorter time than 5 milliseconds.

The filling of the secondary side 5 at a net rate of 70 gallons per minute continues until the uppermost support plate 30 is immersed with water. In a typical Westinghouse Model 51 steam generator, about 17,000 gallons of water must be introduced into the secondary side 5 before the water reaches such a level. At a net fill rate of 70 gallons per minute, the fill cycle takes about four hours. During the fill cycle, the pressure of the gas introduced into the firing cylinder 64 of each air gun 62 is raised from approximately 400 psi to approximately 800 to 900 psi in direct proportion with the water level in the secondary side 5. The proportional increase in the pressure of the gas used in the air guns 62 substantially offsets the diminishment in the power of the pulses created thereby caused by the increasing static water pressure around the tip portion 113 of the nozzle 111 of each.

As soon as the water level in the secondary side 5 is high enough to completely submerge the highest support plate 30, the recirculation cycle commences. If desired, valves 126*a*, 126*b* may be closed and opened, respectively, in order to convert the function of suction-fill hose 121*a* into a suction hose. Moreover, the flow rate of fill pump 155 is lowered from 120 gallons per minute to only 50 gallons per minute, while the withdrawal rate of the diaphragm type suction pump 127 is maintained at 50 gallons per minute. The net result of these adjustments is that water is recirculated through the secondary side 5 of the steam generator 1 at a rate of approximately 50 gallons per minute. This circulation rate is maintained for approximately 12–48 hours while the air guns 62 of each of the generator assemblies 60*a*, 60*b* are fired at a pressure of 800 psi every seven to ten seconds.

After the termination of the recirculation cycle, the drain cycle of the method commences. This step is implemented by doubling the flow rate of the diaphragm-type suction pump 127 so that each of the hoses 121*a*, 121*b* of each pulse generator 60*a*, 60*b* will withdraw approximately 22.5 gallons per minute. Since the fill pump 155 continues to fill the secondary side 5 at a total rate of approximately 50 gallons per minute, the net drain rate is approximately 40 gallons per minute. As the secondary side 5 has about 17,000 gallons of water in it at the end of the recirculation cycle, the drain cycle takes about seven hours. During this period of time, it should be noted that the pressure of the gas introduced into the firing cylinders 64 of the air guns 62 of the generator assembly 60*a*, 60*b* is lowered from 800 psi to 400 psi in proportion with the level of the water in the secondary side 5.

To expedite the cleaning method in a utility where two or more steam generators are to be cleaned, a second steam generator (not shown) may be filled with the filtered and polished water that flows out of the demineralizer 157 of the recirculation system 114 during the drain cycle of a first steam generator. This may be accomplished by wheeling the portable coupling station 168 over to a second generator where other pulse generator assemblies 60*a*, 60*b* have been installed, and coupling the outlet of flowmeter 167*b* to the inlet conduits 119*a*, 119*b* of the second generator. Next, diverter valves 165*a* and 165*b* are adjusted so that part of the filtered and polished water leaving the demineralizer 157 is shunted to the inlet conduits 119*a*, 119*b* of the second generator. In order to maintain the seven hour time period of the drain cycle for the first steam generator, the flow rate of the pump 155 is increased to approximately 170 gallons per minute. The valve 165*a* is adjusted so that the flow rate as indicated by flowmeter 167*a* remains approximately 50 gallons per minute. The balance of the 120 gallon per minute flow is shunted through valve 165*b* to the secondary side 5 of the second steam generator. The implementation of this additional step not only lowers the total amount of time required to clean a plurality of steam generators by as much as 50 percent, but further considerably reduces the amount of deionized and purified water that the utility must supply from source 170 to implement the cleaning method of the invention. As it requires approximately 17,000 gallons or 72 tons of water to clean a single steam generator 1, the savings in water alone are clearly significant. Moreover, by reducing the overall amount of time required to clean two generators, the amount of time that the operating personnel are exposed to potentially harmful radiation is considerably reduced. The portability of the valves 165*a*, 165*b* afforded by the portable conduit coupling station 168 plus the use of a flexible hose for conduit 161 greatly facilitates the implementation of such a combined drain-fill step in the method of the invention.

We claim:

1. A method for loosening and removing sludge and debris from the interior of a steam generator that contain one or more heat exchanger components orthogonally mounted in a tubesheet, comprising the steps of:

a. providing a sufficient amount of liquid in the steam generator to submerge a portion of the interior thereof that includes some of said sludge, debris and heat exchanger components, and b. generating a succession of pressure pulses within the liquid by introducing pulses of pressurized gas within the liquid by means of at least one pressure pulse generator having an opening that communicates with the interior of said steam generator to create omnidirectional shock waves which exert momentary pressures of no more than about 30 ksi on the heat exchanger components to loosen said sludge and debris without exceeding the yield strength of the heat exchanger components, wherein said pulses of pressurized gas are directed toward the tubesheet at an oblique angle to reduce the amount of stress that the resulting shock waves apply to the heat exchanger components.

2. The method as defined in claim 1, wherein said heat exchanger components are heat exchanger tubes.

3. The method as defined in claim 2, wherein the pressure pulse generator generates pressure pulses by introducing pressurized gas into the liquid that is pressurized from between about 200 to 1600 psi.

4. The method as defined in claim 3, wherein said pressure pulse generator generates said pressure pulses by releasing between 50 and 120 cubic inches of gas into the liquid that is pressurized to between 200 and 1600 psi.

5. The method as defined in claim 1, wherein each pressure pulse generator generates one pressure pulse between about every 1 to 15 seconds.

6. The method defined in claim 1, wherein said succession of pressure pulses lasts from 24 to 59 hours.

7. The method as defined in claim 1, wherein said steam generator includes lower and higher portions, and wherein said liquid is provided in said steam generator by filling said steam generator over a selected period of time from said lower to said higher portions, and wherein the generation of said succession of pressure pulses commences when said steam generator is filled to the extent to where said lower portion is submerged.

8. The method as defined in claim 7, wherein said pulses continue as said steam generator is filled with liquid from said lower to said higher portions.

9. The method as defined in claim 1, wherein said steam generator includes lower and higher portions, and wherein said liquid is provided in said steam generator by filling said steam generator over a selected period of time from said lower to higher portions, and then by draining said liquid over a selected period of time from said higher to said lower portions.

10. The method as defined in claim 9, wherein said succession of pressure pulses continues as said liquid is drained from said higher to said lower portion.

11. The method as defined in claim 1, further including the step of removing ionic species from the liquid to remove dissolved debris from the interior of the steam generator.

12. The method as defined in claim 9, further including the step of purifying the liquid as it is being drained from the steam generator to remove the ionic species therefrom.

13. The method as defined in claim 12, further including the step of filling another steam generator with the purified liquid from the first steam generator while said first steam generator is being drained.

14. The method as defined in claim 12, wherein said ionic species are removed by recirculating said liquid through a demineralizer means.

15. The method as defined in claim 9, wherein said liquid is recirculated for a selected period of time between the time said liquid fills said steam generator and the time that said liquid is drained from said steam generator.

16. The method as defined in claim 1, further including the step of flushing said steam generator prior to the commencement of said succession of pressure pulses to remove loose sludge and debris therefrom.

17. The method as defined in claim 1, further including the steps of terminating said succession of pressure pulses, and then flushing said steam generator to remove loose sludge and debris therefrom.

18. The method as defined in claim 7, wherein the pressure pulse generator generates pressure pulses by introducing pressurized gas into the liquid, and wherein the pressure of the gas introduced into the liquid is dependent upon the static pressure that the liquid exerts upon the opening of the pressure pulse generator.

19. The method as defined in claim 1, wherein two pressure pulse generators are positioned on opposite sides of the interior of the steam generator, and further comprising the step of generating pulses by said pulse generators at times asynchronously to control the location in the steam generator where the shock waves produced in the liquid impinge.

20. A method for loosening and removing sludge and debris from the interior of the secondary side of nuclear steam generator that contains a plurality of metallic heat exchanger tubes mounted in a tubesheet, comprising the steps of:

a. introducing a sufficient amount of water into said secondary side to submerge said tubesheet and a portion of said heat exchanger tubes, and b. generating a succession of pressure pulses within the water by introducing pulses of pressurized gas therein that are directed toward the tubesheet at between a 25 to 35 degree angle from the horizontal to create omnidirectional waves which exert momentary pressures throughout the tubesheet and submerged portions of said heat exchanger tubes of a magnitude no greater than 30 ksi to loosen said sludge and debris without exceeding the yield strength of the heat exchanger tubes or causing significant metal fatigue in said tubes.

21. The method as defined in claim 20, wherein the shock waves generated in the water exert momentary pressures on said tubesheet and submerged portions of said heat exchanger tubes no greater than between about 10 and 30 ksi.

22. The method as defined in claim 20, wherein the shock waves generated in the water exert momentary pressures on said tubesheet and submerged portions of said heat exchanger tubes no greater than about 11 and 23 ksi.

23. The method as defined in claim 20, wherein the shock waves generated in the water exert momentary pressures on said tubesheet and submerged portions of said heat exchanger tubes no greater than about 18 and 21 ksi.

24. The method as defined in claim 21, wherein the pressure pulse generator generates pressure pulses by introducing pressurized gas into the liquid that is pressurized from between about 200 to 1600 psi.

25. The method as defined in claim 21, wherein the pressure pulse generator generates pressure pulses by introducing pressurized gas into the liquid that is pressurized from between about 300 to 1200 psi.

26. The method as defined in claim 22, wherein the pressure pulse generator generates pressure pulses by introducing pressurized gas into the liquid that is pressurized from between about 350 to 900 psi.

27. The method as defined in claim 24, wherein said pressure pulses are generated by releasing into said water between about 50 to 120 cubic inches of gas pressurized at between 200 and 1600 psi.

28. The method as defined in claim 25, wherein said pressure pulses are generated by releasing into said water between about 70 and 100 cubic inches of gas.

29. The method as defined in claim 26, wherein said pressure pulses are generated by releasing into said water between about 85 and 90 cubic inches of gas.

30. A method for loosening and removing sludge and debris from the secondary side of a steam generator of the type containing a plurality of heat exchanger tubes mounted in a tubesheet at one end and supported along their length by a plurality of support plates, comprising the steps of:

a. providing a sufficient amount of water within the secondary side to submerge at least said tubesheet and portions of said heat exchanger tubes;

b. generating a succession of pressure pulses within the water by introducing pulses of pressurized gas within the water that are directed at an oblique angle with respect to the tubesheet from one or more pressure pulse generators having openings that communicate with said water in order to generate omnidirectional shock waves in the water that exert momentary pressures on the tubesheet and portions of said heat exchanger tubes between about 15 and 25 ksi.

31. A method for loosening and removing sludge, debris and dissolved matter from the secondary side of a steam generator of the type containing a plurality of heat exchanger tubes mounted in a tubesheet at one end and supported along their length by a plurality of vertically spaced support plates, comprising the steps of:

a. introducing a flow of water into the secondary side of the steam generator;

b. commencing the generation of a plurality of pressure pulses in the water in the secondary side of the steam generator when said water submerges said tubesheet and said heat exchanger tubes, wherein each of said pulses is generated by introducing between 60 and 100 cubic inches of an inert gas into water surrounding the heat exchanger tubes that is pressurized to between about 350 and 450 pounds per square inch, wherein said pressure pulses are generated at uniform time intervals of between about 5 and 12 seconds;

c. continuing the flow of water into the secondary side of the steam generator until the level of the water within the secondary side thereof is sufficiently high to immerse all of the support plates therein;

d. continuing the generation of pressure pulses at uniform intervals at a time between 5 and 12 seconds while the level of the water in the secondary side is raised to immerse all of the support plates, wherein the pressure of the pressurized gas used to generate the pressure pulses is increased from between about 350 to 450 psi to between about 750 to 850 psi;

e. draining water out of the secondary side of the steam generator while continuing to generate pulses at uniform intervals anywhere between about 5 and 12 seconds by lowering the level of the water in the secondary side from the upper support plates down to a level which immerses only the tubesheet, wherein the pressure of the gas used to generate the pressure pulses is lowered as the level of the water is lowered from between about 750 to 850 psi to between about 350 to 450 psi.

32. The method defined in claim 31, wherein said succession of pressure pulses lasts from between about 24 to 52 hours.

33. The method defined in claim 30, further comprising the step of recirculating the water through a recirculation system having a demineralizer bed in order to remove dissolved ionic species in the water while the level of the water is raised to immerse the upper support plates and then lowered to immerse only the tubesheet.

34. The method defined in claim 30, wherein a plurality of pressure pulse generators are used which are positioned uniformly around the circumference of the secondary side of the steam generator, and wherein said generators generate pulses synchronously.

35. The method defined in claim 30, wherein the secondary side of the steam generator includes at least one pair of opposing sludge lance ports, and wherein the pressure pulses are introduced through the opposing sludge lance ports.

36. The method defined in claim 35, wherein the pressure pulses introduced through opposing sludge lance ports are generated slightly asynchronously with respect to one another in order to vary the point over the tubesheet of the steam generator wherein the shock waves resulting from the opposing pulses impinge upon one another.

37. The method defined in claim 30, wherein the water removed from the secondary side of the steam generator as the water level is lowered from the uppermost support plates to the tubesheet is used to fill the secondary side of another steam generator.

38. The method defined in claim 30, wherein the succession of pressure pulses continues from between about 36 to 52 hours.

39. The method defined in claim 30, wherein the succession of pressure pulses continues from between about 46 to 52 hours.

* * * * *